United States Patent [19]

Sochor

[11] 4,004,845

[45] Jan. 25, 1977

[54] HIGH DENSITY ELECTRICAL CONNECTOR EMPLOYING MALE BLADE WITH OFFSET PORTIONS

[75] Inventor: Jerzy R. Sochor, Manhattan Beach, Calif.

[73] Assignee: Elco Corporation

[22] Filed: Apr. 17, 1975

[21] Appl. No.: 569,100

[52] U.S. Cl. ..... 339/258 P

[51] Int. Cl.[2] ..... H01R 13/12

[58] Field of Search ..... 339/221, 252, 256, 258, 339/276 SF

[56] References Cited

UNITED STATES PATENTS

| | | | |
|---|---|---|---|
| 2,664,552 | 12/1953 | Ericsson et al. | 339/256 R |
| 2,785,387 | 3/1957 | Batcheller | 339/258 S |
| 3,287,686 | 11/1966 | Ruehlemann | 339/258 R |
| 3,487,356 | 12/1969 | Buck et al. | 339/242 |
| 3,601,775 | 8/1971 | Longenecker et al. | 339/258 P |
| 3,665,375 | 5/1972 | Thoms et al. | 339/221 M |
| 3,693,139 | 9/1972 | Assmus et al. | 339/258 T |
| 3,757,277 | 9/1973 | Yamanoue et al. | 339/221 M |
| 3,827,005 | 7/1974 | Freind | 339/258 P |
| 3,865,462 | 2/1975 | Cobaugh et al. | 339/258 R |
| 3,871,736 | 3/1975 | Carter | 339/256 R |

FOREIGN PATENTS OR APPLICATIONS

| | | | |
|---|---|---|---|
| 1,540,606 | 4/1968 | France | 339/256 SP |

*Primary Examiner*—Joseph H. McGlynn

[57] ABSTRACT

A high contact density connector system for an edge-mount semiconductor package or a like panel member having densely spaced contact means provided along an edge comprises two mating connector parts, each having a one piece insulator housing retaining a plurality of contacts having mating means arranged in a single row.

10 Claims, 18 Drawing Figures

Fig. 1
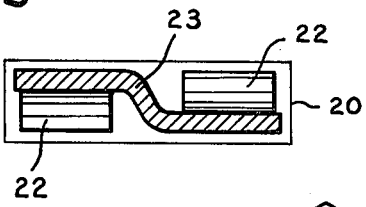
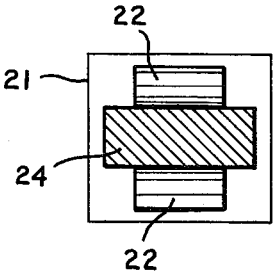
Fig. 2
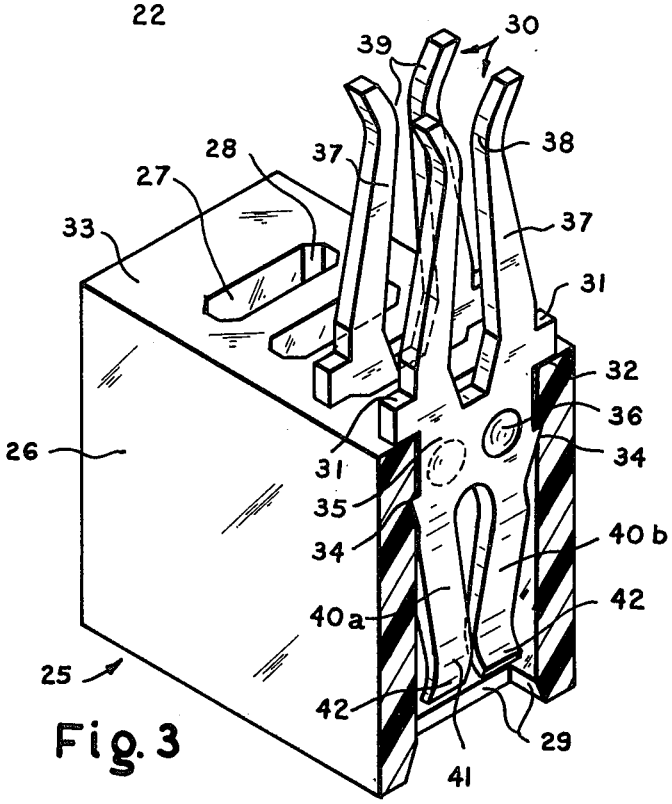
Fig. 3
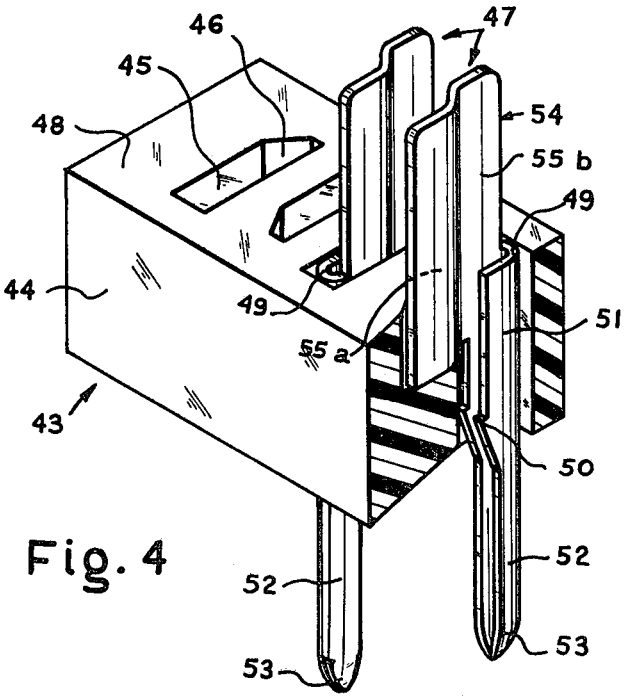
Fig. 4
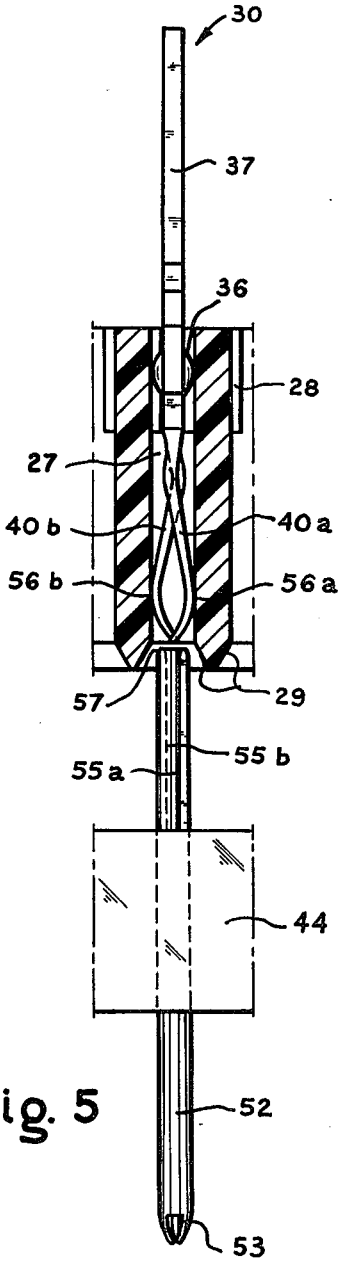
Fig. 5

Fig. 6
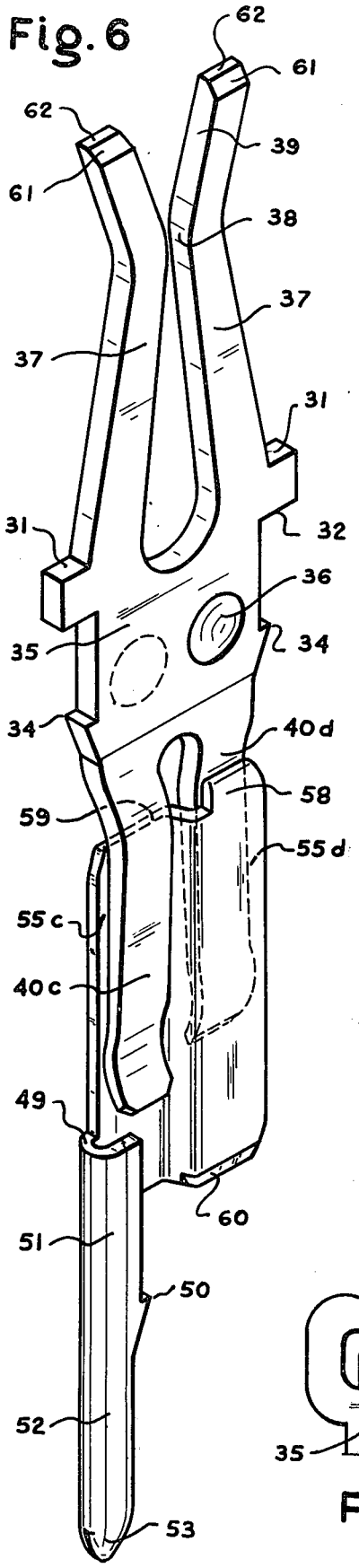
Fig. 7
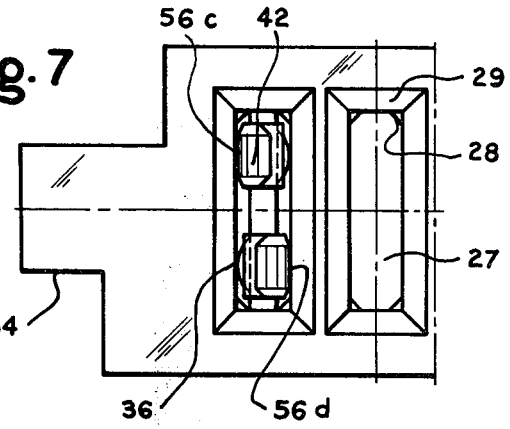
Fig. 8
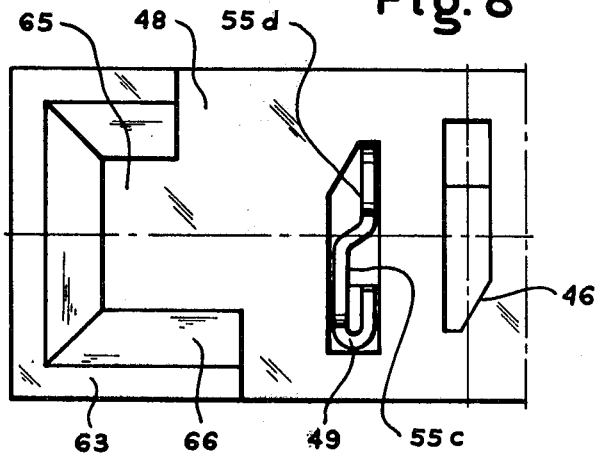
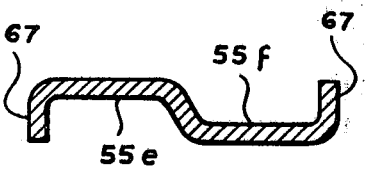
Fig. 9
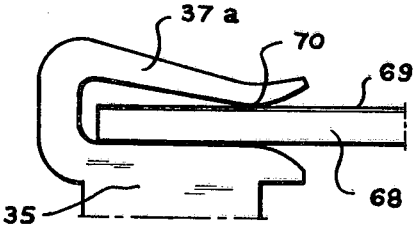
Fig. 10
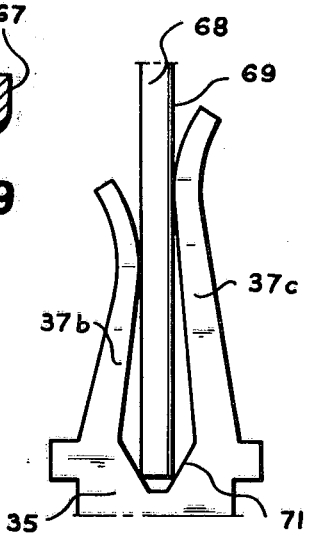
Fig. 11

Fig. 12
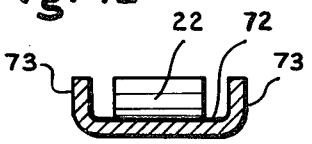
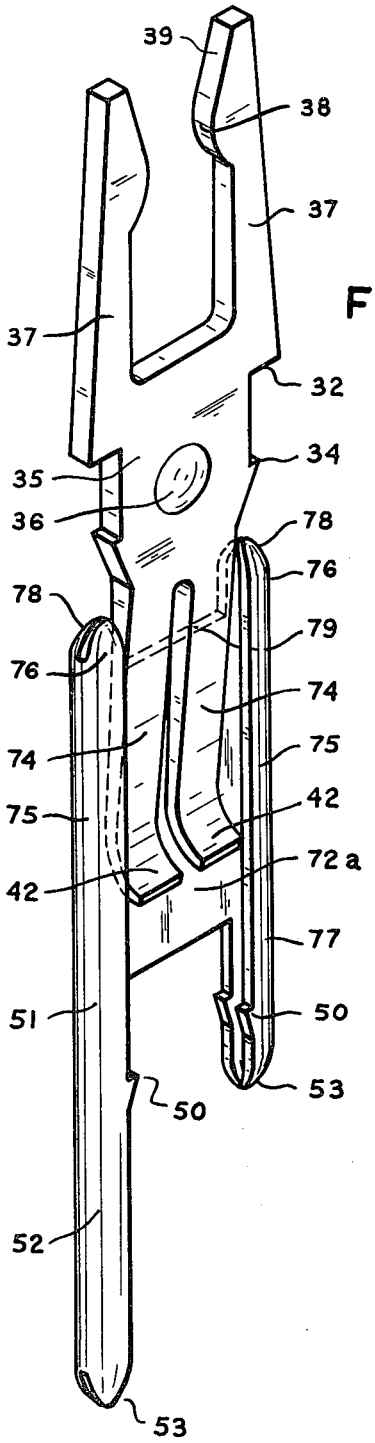
Fig. 13
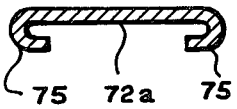
Fig. 14
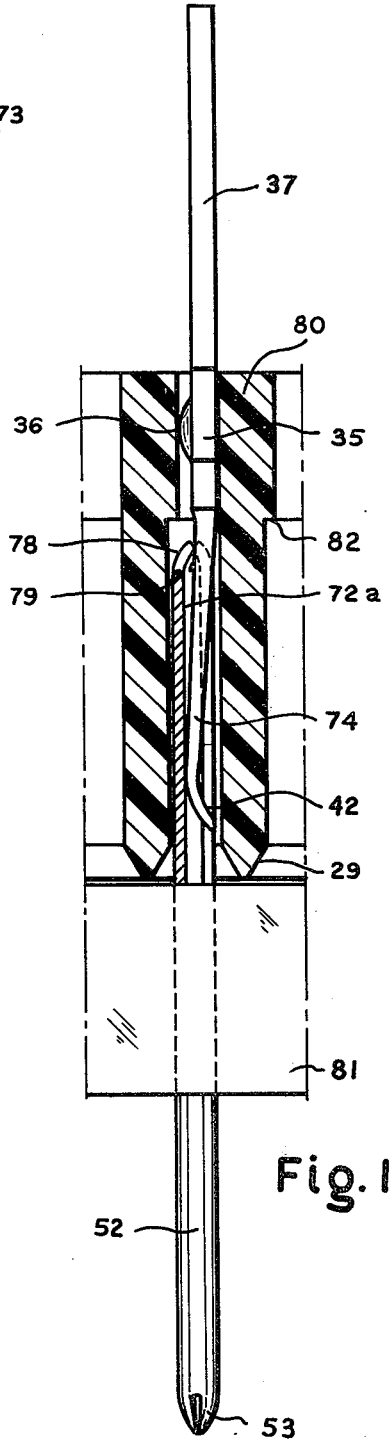
Fig. 15
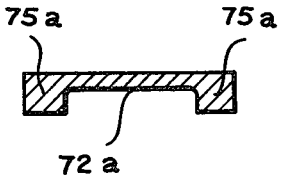
Fig. 16

HIGH DENSITY ELECTRICAL CONNECTOR EMPLOYING MALE BLADE WITH OFFSET PORTIONS

BACKGROUND AND BRIEF SUMMARY OF THE INVENTION.

One piece connectors for substrates or circuit boards having high edge contact density, such as 0.050 inches center to center spacing, exist in the form of a card-edge connector, but their proliferation is impeded by reliability problems experienced by the industry.

While the performance of a 0.050 inches card-edge connector is marginal, any spacing denser than 0.050 inches makes a card-edge connector impractical because of registration problem and poor contact performance.

The spacing, within a single row, of contact centers measuring 0.050 inches and less, such as 0.0375 inches, is the development to which this invention specifically but not exclusively relates.

A two piece connector is desirable for such a dense spacing because it allows a permanent mounting of the circuit board in a pluggable connector through soldering or press-fit, thus shifting the disconnect interface to male and female contact mating means.

An edge-mount packaging approach, in combination with an extremely high density mounting of contacts in a connector is one object of this invention. The present connector is best utilized in applications where size and speed of equipment are major considerations and the two piece connector reliability is required.

In edge-mount packages, as contrasted to face-mount packages such as Dual In-Line packages (Dip's), larger ceramic wafers could be used very effectively, without increasing the interconnection length between any two circuits on the motherboard and allowing larger cavities for hybrid components so as to obtain more functions per package.

This invention provides a high contact density two piece connector, one piece of which, having replaceable male contacts, is permanently solder or press-fit mounted on a motherboard or a wiring panel and the other piece, having receptacle contacts, accepts an edge-mount semiconductor package or a similar panel member and exists as a disconnect module.

Another object of the invention is to provide a simple and versatile resilent coupling contact means which can be formed with an extremely small pitch and adapted to numerous applications by providing suitable extensions to the mating means.

One such extension to the male contact is a solder or a pressfit tail and for the female or receptacle contact a cantilever tab terminal means for resilently receiving a module package board is suitable.

The tails of successive male contacts are alternately rotated 180° in the housing to plug into an offset hole pattern in the circuit board. The mating blades are aligned in a single line for mating with the receptacle contacts, which also have mating portions in a single straight line.

The receptacle contacts could also be installed in the insulator housing alternately rotated 180°, the contacts in such case having unequal substrate receiving cantilever tabs, the shorter of the two making contact to the lower circuit pad and the longer tab reaching the higher pad with savings of space resulting from the staggering utilized to increase pad width.

Such increase in pad width is desired because it provides improved registration and relaxed tolerancing.

A still further object of the invention is to provide high module board retention by driving the board between the two rows of metal cantilever tabs extending upwardly from the receptacle means and outwardly above the insulator housing, registering with high pressure on the package pads and permitting infra-red reflow soldering, visual inspection of registration and on-duty contact probing.

One cantilever tab of each common pair makes electrical contact with the pad on the component side of the package substrate, the other tab providing back-up means and, if desired, serving as a jumper to the circuitry on the other side of the substrate. The term "substrate" as used in this specification, broadly encompasses ceramic substrates circuit boards, flexible circuits or cable or any panel member provided with electrical conductors in either wired or printed form.

BRIEF DESCRIPTION OF THE FIGURES.

FIG. 1 is a graphic illustration of the high density mating principle of the invention.

FIG. 2 is a graphic representation of a connection equivalent to the connection of FIG. 1 but constructed in accordance with the prior art.

FIG. 3 is a sectioned perspective view of a female connector.

FIG. 4 is a sectioned perspective view of a male connector for mating with the female connector of FIG. 3.

FIG. 5 is a fragmentary view of a longitudinally sectioned female connector of FIG. 3 with a male connector fragment of FIG. 4 shown in entering configuration.

FIG. 6 is a perspective view of female and male contacts mated together.

FIG. 7 is a bottom view of a female connector portion, similar to that of FIG. 3.

FIG. 8 is a top view of a male connector portion similar to that of FIG. 4.

FIG. 9 is an alternative cross-sectional profile of the male pin of FIGS. 4 thru 6.

FIGS. 10 and 11 are fragmentary views showing alternative dispositions of the substrate edge recevining cantilever tabs.

FIG. 12 is a graphic representation of an alternative high density mating principle in accordance with the teachings of this invention.

FIG. 13 is a perspective view of a mated contact pair developed from the principle of FIG. 12.

FIG. 14 is a cross-sectional profile of the male blade of FIG. 13.

FIG. 15 is a side view of the contact couple of FIG. 13 shown with its enclosing insulation.

FIG. 16 is an alternative cross-sectional profile of a male pin.

DESCRIPTION OF THE PREFERRED EMBODIMENTS

Figure 17:
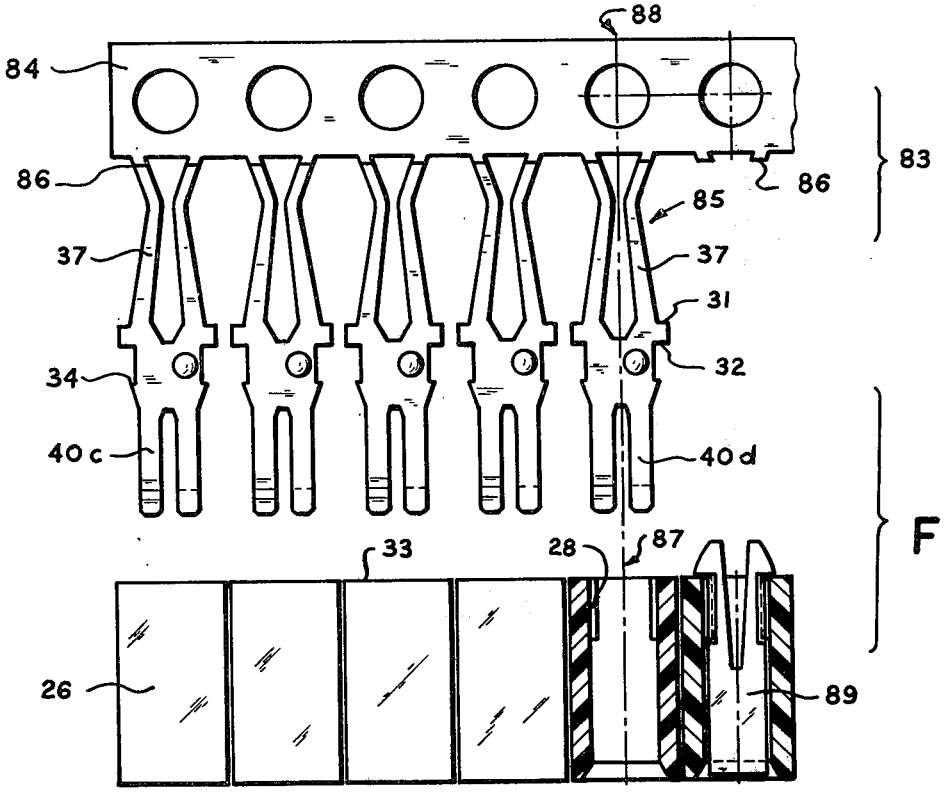
FIG. 17 illustrates an assembly procedure for a female connector.

The attainments of the present invention will become quickly apparent when FIG. 1 is taken in conjunction with FIG. 2.

The two Figures compare the space requirement for the mated contact means, as confined by the insulator housing walls represented by perimeter line 20 for the present invention and perimeter line 21 for a conventional contact pair.

It can be seen that the vertical portions of line 20 of FIG. 1, which determine the linear contact density of the present invention, are less than one-half of the height of the corresponding portions of line 21 of FIG. 1.

Resilent contact means 22 and 22', mating with the male blade sections 23 and 24, are of the same size in both Figures, signifying identical contact spring parameters in both designs.

Similarily, the performed male blade section 23 of the present invention approaches the moment of inertia and thus the rigidity of the solid pin section 24 of the conventional design.

Thus, the mechanical integrity of a standard spacing connector can be now duplicated in half the height or length required until this invention. In FIG. 3 there is shown a section of a connector 25 which comprises a one piece insulator housing 26 molded from a suitable dielectric material.

The housing 26 is provided with a plurality of centrally located contact receiving apertures 27 disposed in a single line. Each aperture 27 is of a generally rectangular form throughout, with contact centering chamfers 28 extending downwardly from the top insulator side through the upper portion of the aperture, and lead-in chamfers 29 on the bottom side perimeter of said aperture to guide the male blades lead-in means.

Contacts 30 are inserted into the housing from the top side as seen in FIG. 3 and driven into the apertures utilizing ears 31 until contact shoulders 32 of ears 31 rest on top insulator surface 33.

An interference fit retention is achieved between the aperture walls and barbs 34 protruding from the sides of contact shank portion 35.

Additional centering and retention may be provided by dimples 36, one on each side of shank 35 in an asymmetrical arrangement.

Substrate receiving tabs 37 extend upwardly from contact shank portion 35 and above insulator top surface 33. Above mating surfaces 38 38, the substrate receiving tabs transition into lead-in portions 39.

The cantilever mating means **40*a* and 40*b* extend downwardly from shank portion 35, are arranged asymmetrically, and remain totally confined in the aperture 27 with mating surfaces 41 preferably contacting the insulator walls they face to provide a preload. The free end portions 42 of cantilever mating means below mating surfaces 41 serve as a lead-in for the mating pin and if viewed from the bottom, appear as represented by resilent contact means 22 in FIG. 1**.

Each cantilever mating means **40*a* and 40*b* is thus seen to comprise a fork tine like member oriented generally in the direction of mating and has a convex mating surface, such as 41**, which faces generally normal to the direction of mating, the respective convex surfaces of each pair of fork tine members facing outwardly in opposite directions which are generally parallel.

In FIG. 4 there is shown a portion of a connector 43 which is a connector for disengageable mating with a connector of FIG. 3. The connector 43 comprises a one piece insulator housing 44 provided with a plurality of contact receiving apertures 45 alternately disposed in a line along the center of the insulator.

Figure 18:
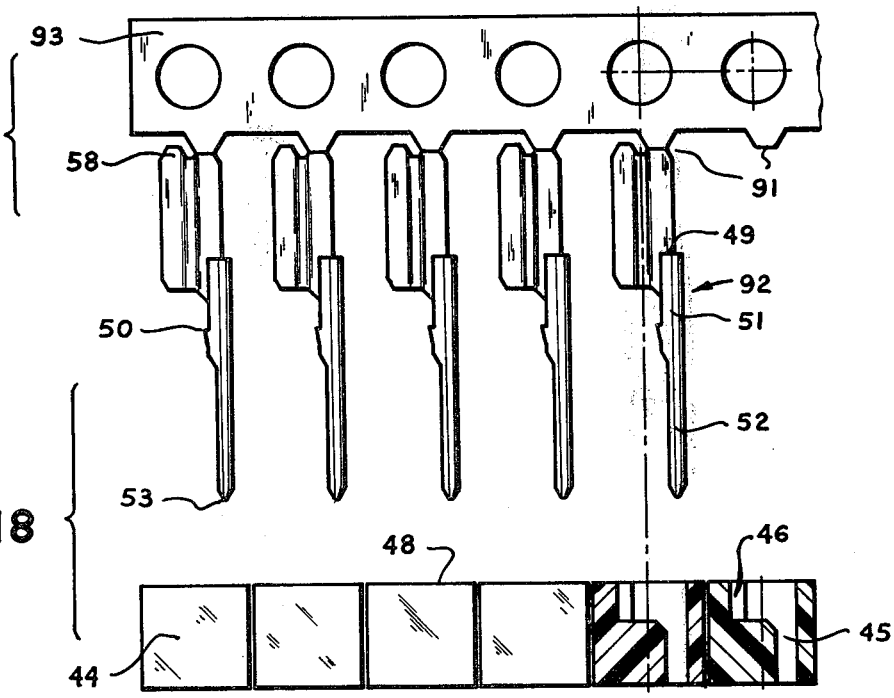
FIG. 18 illustrates an assembly procedure for a male connector.

Each aperture 45 is generally L shaped as seen from the side (FIG. 18) and has a contact restricting chamfer 46 as best illustrated in FIG. 8.

Contacts 47 are inserted into housing from the top side 48 and forced in place utilizing pressure against edge 49 until edge 49 is level with surface 48.

An interference fit retention is effected between barbs 50 and the aperture wall.

Shank portion 51 above the retention barbs 50 can be made somewhat heavier than tail section 52 projecting downwardly from the insulator bottom.

The tail 52 is of a channel or a V form and ends in a pointed tip 53 to provide easy registering in the circuit board holes and also as required for the solderless wrap.

While the solder or press-fit tails 52 are alternately disposed to provide a staggered pattern, mating portions 54 remain in a single row and are uniformly oriented to comply with the pattern of resilent engaging means **40*a* and 40*b* connector 25 of FIG. 3. Upon completion of engagement, between connectors 25 and 43, inside flats 55*a* and 55*b* of each male blade's mating portion 54 will be in contact with contact surfaces 41 of cantilevers 40*a* and 40*b***, thereby effecting two pressure contact areas per connection.

It is seen that blade portion 54 of each male contact protrudes from the housing in the direction of mating, is generally straight in said direction, has a step-like configuration (FIG. 1), and has two edge parts which are generally flat and parallel with each other and with the direction of mating, and an interconnecting part within which a mutual offset between the edge parts is effected.

In FIG. 5, the left side wall of the insulator 26 is removed to illustrate the relation between contact 30 and aperture 27 as viewed from connector's left side.

The contacts are preloaded to provide desirable engagement characteristics, as shown at **56*a* and 56*b***.

Also in FIG. 5, the entry cooperation between, the male blade's top profile 57, lead-in chamfer 29, and the female contacts lead-in portion 42 can be observed.

The male blade's top edge 57 and the side corners are chamfered or rounded to provide an additional lead-in.

As the engagement progresses from the state in the FIG. 5, the female contact cantilevers **40*a* and 40*b* are resilently deflected away from the preload points 56*a* and 56*b* by the entering male blade and make pressure engagement with the male blade's flats 55*a* and 55*b***, respectively.

A damage proof entry of the male blade to the socket-like receiving means of a female connector is achieved without resorting to closed entry protective insulation which is normally required in conventional designs such as represented in FIG. 2.

The damage proof entry in the present invention is enabled by the male blade's unique profile and the complementary female contact without departing from the substantially uniform rectangular character of the usual female insulator aperture, thus eliminating the need for more intricate aperture constructions and the concomitant requirement for mold parting.

FIGS. 6 through 8 depict a design substantially similar to the embodiment described so far and are intended to illustrate a few more features.

It is to be understood, however, that any desired combination of the features described in all the Figures herein and otherwise suggested by the scope of this invention can be used within a single embodiment.

In FIG. 6, a mated contact pair is shown without supporting insulation.

The resilent contact cantilevers 40c and 40d are shown in pressure contact with male pin flats 55c and 55d, respectively. The total resilent deflection is the accumulation of a preload deflection from the free state to preload points 56c and 56d imposed during the contact assembly in the insulator (FIG. 7), plus the deflection imposed by the male contact blade during the mating cycle. Since only a partial deflection takes place during the mating cycle to complete the connection, preloading enables the mating forces to be significantly reduced.

To further decrease the peak insertion force, the male blade's top profile, along which the engaging deflection occurs, can be stepped to provide a tab 58, and thus engage the contact springs 40d and 40c sequentially, and in this order, rather than at the same time. The lower part 59 of the male blade's top profile is a suitable location for a break-off carrier strip.

On the lower side of the male blade, there is a chamfer 60 to facilitate the installation lead-in of the male contact into its housing. The tips of substrate receiving tabs 37 are shown chamfered from a score 61 allowing break-off separation from the carrier strip not shown at 62.

polarizing guide means are illustrated in FIGS. 7 and 8. The polarizing guide 63 of FIG. 8 extends from insulator surface 48, at least the distance equal to the exposed length of the male pin mating portion.

The end section of a mating connector 64 is profiled to be accepted only in one way in polarizing guide opening 65. A lead-in, such as a chamfer 66, can be provided.

In FIG. 9, there is shown an alternative cross-sectional profile of a male mating blade.

The mating flats 55e and 55f are similarily arranged as in the male contact in FIGS. 6 thru 8.

A stiffening edge portion 67, added on each side of the section, constitutes the difference.

In FIG. 10 there is shown an alternative disposition of the substrate receiving means, whereby a board 68, having a circuit trace side 69, can be received horizontally to complete an electrical contact at 70 between said circuit trace and tab 37a.

In case of a rectangular circuit board, all four edges could accept a connector with horizontally oriented substrate receiving means 37a.

In FIG. 11 substrate receiving tabs 37b and 37c are shown of unequal length.

If every other contact is alternately mounted in the insulator, a staggered circuit trace pattern will be possible. Chamfer 71 holds the leading edges of the substrate, thus improving its retention.

In the embodiments described heretofore, the male blade's cross-sectional profile is of a modified Z or S form, with mating flats 55a thru 55f on the opposite sides of the pin.

FIG. 12 illustrates an alternative C shaped pin cross-section having a single mating flat 72 shown in resilent engagement with contact means 22.

If one of stiffening forms 73 is removed, an L shaped cross-section results, which may be employed where further reduction in space requirement for the mated contact means is desired.

Conversely, as represented in FIG. 13, mating flat 72a can be made wider and engage with two substantially independent resilent contact cantilevers 74 and thus provide a redundant connection. In FIG. 13, which depicts a mated contact pair without, enclosing insulation, many features are easily recognized to correspond to analogous features in the FIG. 16.

Although not necessarily identical, the corresponding features are designated by the same numerals to emphasize the common scope of these embodiments.

Stiffening channels 75 on both sides of the male blade, transition into two short lead-in bosses 76 on the top side of the pin and into two tails on the bottom side of the pin.

Shorter tail 77 is intended as a stabilizing and retaining means as is section 51 of the longer tail.

When the male contact is assembled into its housing, the shorter tail is fully enclosed. Lead-in bosses 76 have rounded tips 78 which cooperate with the lead-in chamfers in an insulator opening during the initial phase of the engagement cycle. Bosses 76 are elevated above engaging edge 79 so that only after bosses 76 are fully entered to the mating connector opening, the actual engagement between edge 79 and resilent contact lead-ins 42 will begin.

Insulater 80 and the mating portion of the male pin are sectioned through the plane coincident with the insulator longitudinal symmetry plane.

The contact receiving apertures in insulators 80 and 81 are similarily disposed as those of FIGS. 3 and 4.

Step 82 is provided to increase the amount of insulation surrounding the contact shank portion 35 in order to optimize the contact retention and structural strength of insulator 80. Step 82 can also serve as an engagement limiting stop for the male pin and as a positive seating means for a keying plug. In FIG. 16 there is shown an alternative construction of a male pin cross-sectional profile.

Stiffening means 75a are solid as opposed to the channel-like stiffening means 75 in FIG. 14.

The section of FIG. 16 can be achieved by forming a pre-profiled metallic strip in a stamping die.

In FIG. 17 there is shown a contact strip 83 comprising carrier portion 84 and individual contacts 85 separably attached to the carrier strip at break-off edges 86.

Immediately below contact strip 83 an end side view of a grouping of insulator housings 26 is shown, into which contacts 85 are to be assembled.

The longitudinal center plane 87 of each insulator housing 26 is oriented transversely to contact strip 83 and coincides with respective contact centerline 88.

Furthermore, each individual contact 85 is vertically linedup with a respective aperture in the insulator into which it is being assembled.

A large number of contacts, e.g. 50 or 100, can be assembled in the insulators simultaneously in a strip form, and then carrier strip 84 can be broken away using suitable fixturing.

If desired, a contact 85 can be omitted in a specified aperture and a keying plug 89 resilently installed in place of the contact to allow mating only with the mating connector which has a male blade contact omitted in a corresponding contact position.

If a mismatch is attempted, the male pin corresponding to the key location will be blocked from entering, thus preventing engagement. The contact assembly procedure heretofore described is applicable to contact strip 90 and insulators 44 of FIG. 18. Break-off edge 91 is scored to facilitate separation of a contact 92 from carrier strip 93.

While I have illustrated and described this invention with respect to several embodiments, they can not be exhaustive merely because of the multitude of connector applications to which a basic pair of contact mating means can be adapted. The true scope of the invention is therefore indicated only by the appended claims and their legal equivalents.

I claim as new:

1. A connector comprising mating male and female halves, said male half comprising an insulator housing, a plurality of contacts mounted in a row having a given direction in said housing, said contacts having an elongated configuration, one end of each contact constituting a mating end, the rest of each contact comprising means for securely mounting said contact in said housing and effecting a tail connection with said contact, said mating end comprising a blade portion protruding from a portion of said insulating housing in a direction of mating, said blade portion being generally straight in said direction of mating and comprising a first generally flat part oriented generally parallel to said direction of mating and generally normal to said given direction of said row, a second generally flat part oriented generally parallel to but spaced from the plane of said first generally flat part, and an interconnecting part being substantially narrower in width than said first and second generally flat parts, and integrally joining said first and second generally flat parts such that said blade has a general step-like configuration when viewed in the direction of mating, said female half comprising an insulating housing, a plurality of female contacts mounted in said housing, said contacts having an elongated configuration, one end of each contact consitituting a mating end, the rest of each contact comprising means for securely mounting said contact in said housing and effecting a tail connection with said contact, said mating end comprising a pair of elongated fork tine members oriented in a direction of mating, each of said fork members having a convex mating surface facing generally normal to said direction of mating, the convex surfaces of said respective tine members facing outwardly in opposite but generally parallel directions, said female contact being positioned in said insulating housing to mate with respective ones of said male contacts when said male and female halves are brought together, said fork tine members of each of said female contacts being shaped and spaced such that the convex surfaces thereof will press against respectively opposite sides of the blade portion of its corresponding male contact when mated therewith.

2. The connector half of claim 1 wherein said blade portion of said each male contact has a generally uniform thickness.

3. The connector half of claim 1 wherein said blade portion of said each male contact is pre-profiled by coining said first and second generally flat parts.

4. The connector half of claim 1 wherein said blade portion of each male contact comprises two further parts adjoining the outer edges of said first and second generally flat parts respectively, and narrower than said first and second generally flat parts, thereby to reinforce said blade portion.

5. The connector half of claim 1 wherein the rest of each of said male contacts comprises a body portion having means for seating in said housing and a tail portion, at the other end of said contact, which protrudes from said housing.

6. The connector half of claim 5 wherein said body and tail portions of each male contact comprise a generally U-shaped configuration.

7. The connector half of claim 1 wherein the facing edges of said tine members of each female contact are spaced from each other in a direction perpendicular to said direction of mating and said directions in which said convex mating surfaces face, thereby to be able to accommodate said interconnecting part of said blade portion of said male contact.

8. The connector of claim 7 wherein said tine members overlap when not mated with said male contact and when viewed in said direction perpendicular to said direction of mating and said direction in which said convex mating surfaces face.

9. The connector of claim 7 wherein said tine members overlap when mated with said male contact and when viewed in said direction perpendicular to said direction of mating and said direction in which said convex mating surfaces face.

10. The connector of claim 7 wherein said tine members are each preloaded such that each convex mating surface is deflected inwardly from its free state position and in a direction opposite to the direction in which such convex mating surface faces.

* * * * *